US008790857B2

(12) United States Patent
Itou et al.

(10) Patent No.: US 8,790,857 B2
(45) Date of Patent: Jul. 29, 2014

(54) TONER AND PROCESS FOR PRODUCTION THEREOF

(75) Inventors: Tsuyoshi Itou, Shizuoka-ken (JP); Motonari Udo, Shizuoka-ken (JP); Kazuhisa Takeda, Shizuoka-ken (JP); Takayasu Aoki, Shizuoka-ken (JP); Masahiro Ikuta, Shizuoka-ken (JP); Takafumi Hara, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/537,387

(22) Filed: Jun. 29, 2012

(65) Prior Publication Data

US 2013/0011775 A1 Jan. 10, 2013

(30) Foreign Application Priority Data

Jul. 8, 2011 (JP) ..... 2011-151353

(51) Int. Cl.
*G03G 9/00* (2006.01)

(52) U.S. Cl.
USPC ..... 430/110.2; 430/137.13; 430/109.4; 399/252

(58) Field of Classification Search
USPC ..... 430/110.2, 137.13, 109.4; 399/252
See application file for complete search history.

(56) References Cited

U.S. PATENT DOCUMENTS

| | | | |
|---|---|---|---|
| 5,849,456 A | 12/1998 | Matsumura et al. | |
| 8,409,775 B2 | 4/2013 | Suzuki et al. | |
| 2004/0058266 A1 * | 3/2004 | Matsumura et al. | 430/109.2 |
| 2010/0183969 A1 | 7/2010 | Suzuki et al. | |
| 2010/0209839 A1 | 8/2010 | Kabai et al. | |

FOREIGN PATENT DOCUMENTS

| | | |
|---|---|---|
| CN | 101796102 | 8/2010 |
| JP | P3457538 | 8/2003 |
| JP | 2004-163854 | 6/2004 |
| JP | 2008-076778 | 4/2008 |
| JP | P4204360 | 10/2008 |
| JP | 2010-48954 | 3/2010 |
| JP | 2010-78828 | 4/2010 |
| JP | 2010-191430 | 9/2010 |
| JP | 2013-008026 | 1/2013 |
| JP | 2013-019971 | 1/2013 |
| JP | 2013-019973 | 1/2013 |

OTHER PUBLICATIONS

Office Action of Notification of Reasons for Refusal for Japanese Patent Application No. 2011-151353 Dated Jun. 11, 2013, 6 pgs.
Office Action of Final Notification of Reasons for Refusal for Japanese Patent Application No. 2011-151353 Dated Oct. 29, 2013, 6 pgs.
Office Action of First Notice of Opinion on Examination for Chinese Patent Application No. 201210173098.1 Dated Dec. 4, 2013, 25 pgs.

* cited by examiner

*Primary Examiner* — Mark A Chapman
(74) *Attorney, Agent, or Firm* — Amin, Turocy & Watson, LLP

(57) ABSTRACT

Disclosed is a toner obtained by coating surfaces of core particles including at least a binder resin having a carboxyl group and a coloring agent with successive coatings of a water-soluble crosslinking agent capable of crosslinking with a carboxyl group and a water-soluble polymer having a carboxyl group, which have been successively applied on the core particles and crosslinked with each other. The thus-formed toner is provided with a good harmony of favorable fixability represented by a low lowest fixable temperature and favorable storage stability represented by little aggregation after standing at 50° C. for 8 hours.

11 Claims, 4 Drawing Sheets

TONER AND PROCESS FOR PRODUCTION THEREOF

CROSS-REFERENCE TO RELATED APPLICATIONS

This application is based upon and claims the benefit of priority from Japanese Patent Application No. 151353/2011, filed Jul. 8, 2011; the entire contents of which are incorporated herein by reference.

FIELD

Embodiments described herein relate generally to a toner which achieves both low-temperature fixability and storage stability, and a process for production thereof.

BACKGROUND

With the recent promotion of conservation of energy, a toner which is fixed at a low temperature as a property required for the toner is demanded. However, if a binder resin having a low glass transition temperature for a toner is selected for achieving low-temperature fixability, the storage stability of the toner is inevitably deteriorated. In order to solve this problem, a method in which a toner is encapsulated by coating a toner surface with a resin having a high glass transition temperature or a resin having a crosslinked structure is being studied.

As representative examples of the toner encapsulation method, there are: a method of attaching and fusing resin particles to surfaces of toner particles; and a method of reacting a polymerizable monomer on surfaces of toner particles.

As a conventional method of attaching and fusing resin particles to surfaces of toner particles, there is known a following technique. Toner component particles are aggregated to form core particles in water, and then, fine particles for a shell are attached thereto to effect coating, followed by melting the fine particles through heating, whereby a toner is obtained. According to this method, there is a possibility that both low-temperature fixability and storage stability can be achieved by preparing the shell particles having a higher thermal characteristic than the core particles, but since the size of the shell particles is about 0.1 μm, a formed shell layer becomes relatively thick, and therefore, the resultant toner is liable to have an inferior low-temperature fixability.

On the other hand, it is known to react a polymerizable monomer on surfaces of toner particles. In this method, the particles are coated with a urea resin by an in situ polymerization method, and an extremely thin shell layer can be formed. However, since a monomer having a low molecular weight is used, the resulting resin is caused to have a dense crosslinked structure, and therefore, the resultant toner is liable to have an inferior low-temperature fixability. Further, the toner tends to have a poor chargeability, and moreover, the toner is accompanied with a problem due to residues of formaldehyde used as the monomer.

DETAILED DESCRIPTION

Figure 1:
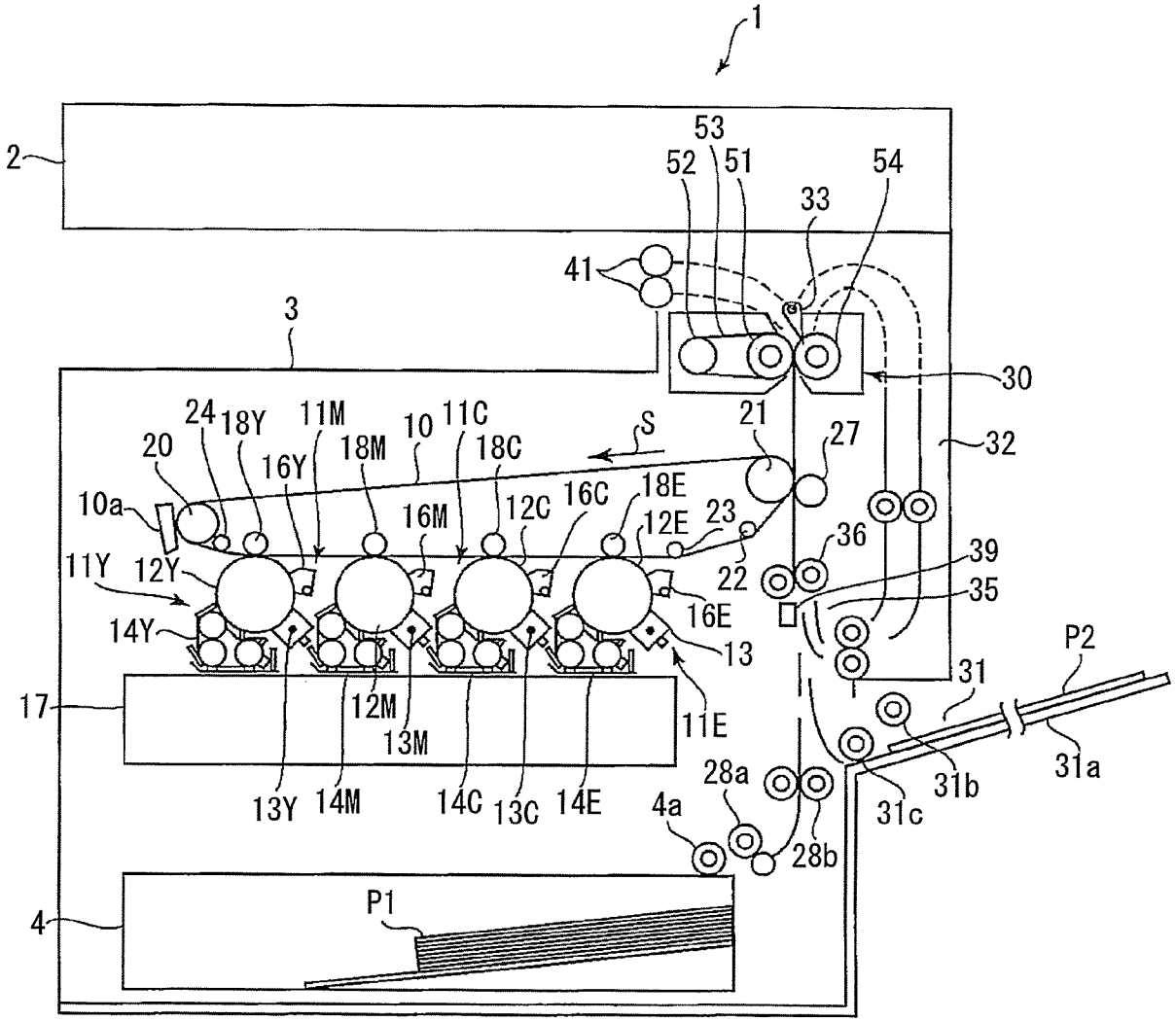
FIG. 1 is an overall arrangement view showing an image forming apparatus to which a developer according to an embodiment is applicable.

Embodiments described herein allow the production of a toner which achieves both low-temperature fixability and storage stability by forming an extremely thin shell layer.

An embodiment described herein provides a toner, comprising: core particles comprising at least a binder resin having a carboxyl group and a coloring agent, and a crosslink coating formed by coating the core particles successively with a water-soluble crosslinking agent and a water-soluble polymer having a carboxyl group.

Another embodiment described herein provides a process for production of a toner, comprising:

mixing core particles comprising at least a binder resin having a carboxyl group and a coloring agent with a water-soluble crosslinking agent capable of crosslinking with a carboxyl group in an aqueous dispersion medium, and adding a water-soluble polymer having a carboxyl group to the aqueous dispersion According to the process, since the water-soluble crosslinking agent and the water-soluble polymer are sequentially attached in the form of a thin film, respectively, and then crosslinked and cured on the surfaces of the core particles in the aqueous dispersion liquid of the core particles, an extremely thin shell layer can be formed, and also unlike the coating by a reaction of a polymerizable monomer, a safety problem due to the residual monomer does not occur. Further, since the carboxyl group on the surfaces of the core particles is moderately consumed by the reaction, it is also possible to form a toner having excellent chargeability.

Hereinafter, embodiments will be described sequentially. In the following description, "%" and "part(s)" representing a composition or a compositional ratio are expressed by weight unless otherwise noted specifically.

A toner according to this embodiment is a capsule toner having a shell layer with a crosslinked structure which is very thin, rigid, and flexible. In the toner particles, the water-soluble crosslinking agent (layer) crosslinks with a carboxyl group of the particles containing the binder resin and the coloring agent serving as the core components, and also crosslinks with the water-soluble polymer having a carboxyl group (hereinafter referred to as "water-soluble polycarboxylic acid"). Therefore, it is considered that on the surfaces of the particles, a resin layer (shell layer) obtained by reacting the crosslinking agent with the polycarboxylic acid is formed, and the resin layer is chemically bonded to the core components. Accordingly, the resultant toner has a strong capsule structure which can withstand a mechanical load and a chemical load. Further, the thickness of the shell layer can be adjusted by the acid value of the binder resin, the type of the crosslinking agent, the addition amount of the crosslinking agent, the acid value of the polycarboxylic acid, the molecular weight of the polycarboxylic acid, the addition amount of the polycarboxylic acid, or the reaction temperature. As the thickness of the shell layer is increased, the storage stability is increased. However, in order not to deteriorate the fixability of the toner, it is preferred that the shell is formed so as to have a minimum thickness capable of maintaining the storage stability. The thickness of the shell layer can be determined by calculation from the radius of the core particles, the specific gravity of the core particles, the addition amount of the shell material, and the specific gravity of the shell material, and is preferably in a range of from 0.2 nm to 20 nm.

(Production of Core Particles)

In order to produce the toner according to this embodiment, first, core particles comprising at least a binder resin having a carboxyl group and a coloring agent are produced. Examples of the binder resin having a carboxyl group include styrene-based resins such as styrene-acrylic copolymers, polyester resins, acrylic resins, phenolic resins, epoxy-based resins, allyl phthalate-based resins, polyamide-based resins, and maleic resins. These resins may be used alone or in combination of two or more species thereof. These resins may have an acid value (JIS K0070) of from 5 to 50 mg-KOH/g, more preferably from 10 to 30 mg-KOH/g. Further, these resins may have a glass transition temperature of from 30 to 80° C. and a softening point of from 60 to 180° C. In particular, a polyester resin having favorable fixability is preferred.

As the method for producing the core particles, any known method for producing toner particles, such as a kneading pulverization method, a suspension polymerization method, an aggregation method, and a dissolution suspension method, may be adopted. Several preferred embodiments for the production of the core particles will be supplementarily described later.

If the core particles (toner particles before the capsule coating according to this embodiment) are obtained in a dry state, the core particles are dispersed in an aqueous dispersion medium using a dispersing agent such as a surfactant, whereby an aqueous dispersion liquid of the core particles is formed. The aqueous dispersion medium may be composed only of water in many cases, but, if necessary, a water-miscible liquid such as an alcohol or acetone can be also incorporated therein in an appropriate amount. At this time, when a water-soluble crosslinking agent according to this embodiment is used to disperse the core particles, a crosslinking reaction can be efficiently performed.

According to this embodiment, after adding the water-soluble crosslinking agent, the water-soluble polymer having a carboxyl group is added to cause a crosslinking reaction.

On the other hand, if the core particles are produced by a wet method such as a suspension polymerization method, an aggregation method, or a dissolution suspension method, it is also possible to perform a crosslinking reaction by sequentially adding the water-soluble polymeric crosslinking agent and the water-soluble polymer having a carboxyl group directly to the aqueous dispersion liquid containing the core particles. Further, the water-soluble polymeric crosslinking agent of this embodiment can also be added during the production of the core particles.

More specifically, to the aqueous dispersion liquid of the core particles obtained in the above, under stirring preferably while being heated to 30 to 95° C., the water-soluble polymeric crosslinking agent and the water-soluble polycarboxylic acid, each preferably in the form of an aqueous solution are sequentially added to cause the crosslinking reaction. In this embodiment, it is sufficient that the mixing of the core particles and the water-soluble polymeric crosslinking agent in the aqueous dispersion medium may be performed prior to the addition of the water-soluble polycarboxylic acid, and therefore, the order of the addition of the core particles and the water-soluble polymeric crosslinking agent to the aqueous dispersion medium is arbitrary, so that the two components may be added simultaneously, or either one may be added prior to the other.

The water-soluble polycarboxylic acid is preferably added after the water-soluble polymeric crosslinking agent and the core particles have been sufficiently reacted with each other. A time of at least 0.5 to 12 hours may be required for the reaction between the crosslinking agent and the core particles although it can vary depending on the temperature. Further, also after the addition of the water-soluble polycarboxylic acid, it is preferred to ensure a sufficient reaction time. The reaction between the crosslinking agent and the water-soluble polycarboxylic acid should require a time of at least 0.5 to 12 hours although it can vary depending on the temperature.

The concentration of the core particles in the aqueous dispersion liquid before adding the water-soluble crosslinking agent, etc., is from 1 to 50%, preferably from 10 to 40%. If the concentration thereof is less than 1%, the productivity is low, and if the concentration thereof exceeds 50%, a slurry state cannot be obtained, so that the production cannot be performed. The particle diameter of the core particles is from 1 to 20 μm, preferably from 3 to 15 μm. If the particle diameter is less than 1 μm or exceeds 20 μm, the handling thereof as toner particles becomes difficult.

As the water-soluble crosslinking agent which crosslinks with a carboxyl group, any type of compound can be used as long as it is a water-soluble compound which reacts with a carboxyl group, and examples thereof include isocyanate-based crosslinking agents, oxazoline-based crosslinking agents, aziridine-based crosslinking agents, and carbodiimide-based crosslinking agents. The molecular weight thereof is preferably from 1000 to 1000000. From the viewpoint of safety and chargeability, a water-soluble polymer having an oxazoline group as an oxazoline-based crosslinking agent or a water-soluble polymer having a carbodiimide group as a carbodiimide-based crosslinking agent, is preferred. Examples of commercially available product thereof include CARBODILITE SV-02, V-02, V02-L2 and V-04, all of which are by Nisshinbo Chemical Inc.; and EPOCROS WS300, WS500, and WS700, all of which are made by Nippon Shokubai Co., Ltd.

As the water-soluble polymer having a carboxyl group (water-soluble polycarboxylic acid), any polymer can be used as long as it is a water-soluble polymer having a carboxyl group per molecule, and examples thereof include polymers formed from, as a monomer, acrylic acid, methacrylic acid, fumaric acid, maleic acid, aspartic acid, crotonic acid, itaconic acid, or citraconic acid, copolymers formed therefrom, and metal salts, ammonium salts and esterification products thereof, and mixtures of these (co)polymers. Among these, from the viewpoint of water solubility and properties of the resulting coating film, an acrylic polymer (a homopolymer or a copolymer) is particularly preferred. The water-soluble polymer preferably has a weight-average molecular weight (a polyethylene glycol-based weight-average molecular weight as measured by GPC) of from 1000 to 1000000, and an acid value of from 10 to 10000 (mg-KOH/g). Further, if the water-soluble polycarboxylic acid is a metal salt or an ammonium salt, the crosslinking reaction can be inhibited, and therefore, it is preferred not to use a salt in which all of the carboxyl groups have formed salts. Such a condition can be adjusted through pH adjustment, but the pH during the reaction may be from 2 to 12, preferably from 2 to 10.

The aqueous dispersion liquid after the addition of the water-soluble crosslinking agent and the water-soluble polycarboxylic acid, is preferably heated for accelerating the crosslinking reaction within an extent of not causing adverse effects (for example, deterioration of the coloring agent). This is because a required degree of crosslinking can be achieved with a small amount of the water-soluble crosslinking agent and a small amount of the water-soluble polycarboxylic acid in a short time. The heating temperature is preferably from 30 to 95° C., particularly preferably from 35 to 80° C. Further, if the aqueous dispersion liquid is heated to a temperature not lower than the glass transition point of the binder resin, the pH adjustment may be performed so as to make the reaction system alkaline. By doing this, the coalescence of the core particles during heating can be prevented. The addition amounts of the water-soluble polymeric crosslinking agent and the water-soluble polycarboxylic acid are both preferably from 0.01% to 50%, particularly preferably from 0.01% to 20% based on the amount of the core particles.

Next, some preferred embodiments of the production of the core particles will be supplementarily described. The core particles (toner particles before encapsulation) to be used in this embodiment comprise at least the above-described binder resin having a carboxyl group and also a coloring agent.

As the coloring agent, a carbon black, an organic or inorganic pigment or dye, etc., is used. Examples of the carbon black include acetylene black, furnace black, thermal black, channel black, and Ketjen black. Examples of a yellow pigment include C.I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, and 185; and C.I. Vat Yellow 1, 3, and 20. These can be used alone or in admixture. Examples of a magenta pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238; C.I. Pigment Violet 19; and C.I. Vat Red 1, 2, 10, 13, 15, 23, 29, and 35. These can be used alone or in admixture. Examples of a cyan pigment include C.I. Pigment Blue 2, 3, 15, 16, and 17; C.I. Vat Blue 6, and C.I. Acid Blue 45. These can be used alone or in admixture.

The core particles comprising at least a binder resin having a carboxyl group and a coloring agent may preferably contain a release agent. Further, as the coloring agent, an erasable color material may be used. Further, the core particles may contain a charge control agent.

Examples of the release agent include aliphatic hydrocarbon-based waxes such as low-molecular weight polyethylene, low-molecular weight polypropylenes, polyolefin copolymers, polyolefin waxes, microcrystalline waxes, paraffin waxes, and Fischer-Tropsch waxes; oxides of an aliphatic hydrocarbon-based wax such as polyethylene oxide waxes or block copolymers thereof; vegetable waxes such as candelilla wax, carnauba wax, Japan wax, jojoba wax, and rice wax; animal waxes such as beeswax, lanolin, and spermaceti wax; mineral waxes such as ozokerite, ceresin, and petrolatum; waxes containing, as a main component, a fatty acid ester such as montanic acid ester wax and castor wax; and deoxidization products resulting from deoxidization of a part or the whole of a fatty acid ester such as deoxidized carnauba wax. Further, saturated linear fatty acids such as palmitic acid, stearic acid, montanic acid, and long-chain alkyl carboxylic acids having a long-chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and long-chain alkyl alcohols having a long-chain alkyl group; polyhydric alcohols such as sorbitol; fatty acid amides such as linoleic acid amide, oleic acid amide, and lauric acid amide; saturated fatty acid bisamides such as methylenebis stearic acid amide, ethylenebis caprylic acid amide, ethylenebis lauric acid amide, and hexamethylenebis stearic acid amide; unsaturated fatty acid amides such as ethylenebis oleic acid amide, hexamethylenebis oleic acid amide, N,N'-dioleyl adipic acid amide, and N,N'-dioleyl sebacic acid amide; aromatic bisamides such as m-xylene-bis stearic acid amide and N,N'-distearyl isophthalic acid amide; fatty acid metal salts (generally called metallic soaps) such as calcium stearate, calcium laurate, zinc stearate, and magnesium stearate; waxes obtained by grafting a vinyl-based monomer such as styrene or acrylic acid onto an aliphatic hydrocarbon-based wax; partially esterified products of a fatty acid and a polyhydric alcohol such as behenic acid monoglyceride; and methyl ester compounds having a hydroxyl group obtained by hydrogenation of a vegetable fat or oil can be exemplified.

As the charge control agent, for example, metal-containing azo compounds may be used, among which a complex or a complex salt containing iron, cobalt or chromium as the metal element, or a mixture thereof, is preferred. Further, metal-containing salicylic acid derivatives can also be used, among which a complex or a complex salt containing zirconium, zinc, chromium, or boron, as the metal element, or a mixture thereof, is preferred.

As the coloring agent, an erasable color material can be used. The erasable color material may comprise a color-forming compound and a color-developing agent, and if necessary further contains a decoloring agent.

The color-forming compound is represented by a leuco dye and is an electron donating compound capable of developing a color by the action of a color-developing agent. Examples thereof include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used alone or by mixing two or more species thereof.

The color-developing agent which causes the color-forming compound to form a color is an electron accepting compound which donates a proton to the leuco dye. Examples thereof include phenols, metal salts of phenols, metal salts of carboxylic acids, aromatic carboxylic acids, aliphatic carboxylic acids having 2 to 5 carbon atoms, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof. Additional examples thereof include those having, as a substituent, an alkyl group, an aryl group, an acyl group, an alkoxycarbonyl group, a carboxy group or an ester thereof, an amide group, a halogen group, etc., and bisphenols, trisphenols, phenol-aldehyde condensed resins, and metal salts thereof. These compounds may be used alone or by mixing two or more species thereof.

Specific examples thereof include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof such as 2,3-dihydroxybenzoate and methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis(4-hydroxyphenyl)-n-heptane, 1,1-bis(4-hydroxyphenyl)-n-octane, 1,1-bis(4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)-n-heptane 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylenetris-p-cresol.

In a preferred embodiment, a decoloring agent may be contained. As the decoloring agent, in such a three-component system including a color-forming compound, a color-developing agent, and a decoloring agent, a known compound can be used as long as the compound inhibits the coloring reaction between the leuco dye and the color-developing agent through heating, thereby making the system colorless.

As the decoloring agent, particularly, a decoloring agent, which is disclosed in JP-A-60-264285, JP-A-2005-1369, JP-A-2008-280523, etc., and provides a coloring and decoloring mechanism showing a temperature hysteresis in a combination of the color-forming compound and the color-developing agent, has an excellent instantaneous erasing property. When a mixture of such a three-component system in a colored state is heated to a specific decoloring temperature Th or higher, the mixture can be decolored. Further, even if the decolored mixture is cooled to a temperature below Th, the decolored state is maintained. When the temperature of the mixture is further lowered, a coloring reaction between the leuco dye and the color-developing agent is resumed at a specific color restoring temperature Tc or lower, and the mixture returns to a colored state. In this manner, it is possible to cause a reversible coloring and decoloring reaction. In particular, it is preferred that the decoloring agent to be used in this embodiment satisfies the following relation: $Th>Tr>Tc$, wherein Tr represents room temperature.

Examples of the decoloring agent capable of causing this temperature hysteresis include alcohols, esters, ketones, ethers, and acid amides.

Particularly preferred are esters. Specific examples thereof include esters of carboxylic acids containing a substituted aromatic ring, esters of carboxylic acids containing an unsubstituted aromatic ring with aliphatic alcohols, esters of carboxylic acids containing a cyclohexyl group in each molecule, esters of fatty acids with unsubstituted aromatic alcohols or phenols, esters of fatty acids with branched aliphatic alcohols, esters of dicarboxylic acids with aromatic alcohols or branched aliphatic alcohols, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These compounds may be used alone or by mixing two or more species thereof.

The erasable color material is preferably encapsulated. Examples of a method for forming an encapsulated coloring agent include an interfacial polymerization method, a coacervation method, an in-situ polymerization method, a submerged drying method, and a submerged curing coating method. In particular, an in-situ method in which a melamine resin is used as a shell component, an interfacial polymerization method in which a urethane resin is used as a shell component, etc., is preferred.

In the case of an in-situ method, first, the above-mentioned three components (a color-forming compound, a color-developing agent, and a decoloring agent to be added as needed) are dissolved and mixed, and then, the resulting mixture is emulsified in an aqueous solution of a water-soluble polymer or a surfactant. Thereafter, an aqueous solution of a melamine formalin prepolymer is added thereto, followed by heating to effect the polymerization, whereby encapsulation can be achieved.

In the case of an interfacial polymerization method, the above-mentioned three components and a polyvalent isocyanate prepolymer are dissolved and mixed, and then, the resulting mixture is emulsified in an aqueous solution of a water-soluble polymer or a surfactant. Thereafter, a polyvalent base such as a diamine or a diol is added thereto, followed by heating to effect the polymerization, whereby encapsulation can be achieved.

The 50% volume-average diameter Dv (the diameter of a particle which gives cumulatively 50 vol. % based on the particle size distribution measured using a laser diffraction particle size distribution analyzer "SALD-7000", made by Shimadzu Corporation) of the erasable color material is preferably from 0.5 to 3.5 μm. It was experimentally confirmed that when the coloring agent has a Dv outside the range of from 0.5 to 3.5 μm, the incorporation of the coloring agent into the toner particles is deteriorated. The mechanism of the deterioration of the incorporation of the coloring agent having a small diameter is not exactly known, but it was confirmed that particularly in the case of using an encapsulated color material, when the particle diameter is less than a given value, the incorporation of the coloring agent into a binder resin is deteriorated, and also the amount of generated fine powder is increased.

Further, although depending on the specific types of the color-forming compound and the color-developing agent, by placing the encapsulated coloring agent at a low temperature, for example, between −20° C. and −30° C., the color-forming compound and the color-developing agent can be coupled to each other to develop a color.

An aggregation method which is one of the methods for producing the core particles containing at least a binder resin having a carboxyl group and a coloring agent of this embodiment will be described. According to the aggregation method, after producing precursor fine particles containing at least a binder resin, the aggregated thereof are produced by adding an aggregating agent thereto. Then, the temperature is increased by heating to the glass transition temperature of the binder resin or higher to effect fusion of the surfaces of the particles, whereby the core particles are obtained.

As a method for producing a dispersion liquid of the precursor fine particles containing at least a binder resin, a known method can be used. For example, in the case of a dispersion liquid of binder resin particles, a polymerization method in which a monomer or a resin intermediate is polymerized, e.g., by emulsion polymerization, seed polymerization, mini-emulsion polymerization, suspension polymerization, interfacial polymerization, or in-situ polymerization; or by a phase inversion emulsification method in which a binder resin is softened using a solvent, an alkali, or a surfactant or by heating thereby forming an oil phase, and then an aqueous phase mainly containing water is added thereto thereby obtaining particles; a mechanical emulsification method in which a binder resin is softened using a solvent or by heating, and then the softened binder resin is mechanically pulverized into fine particles in an aqueous medium using a high-pressure pulverizer, a rotor-stator stirrer, etc., can be used. In the case of a dispersion liquid of release agent particles or a dispersion liquid of charge control agent particles, a mechanical pulverization method in which a release agent or a charge control agent is mechanically pulverized into fine particles in an aqueous medium using a high-pressure pulverizer, a rotor-stator stirrer, a media-type pulverizer, etc., can be used.

On the other hand, other than the method for producing fine particles of each of the toner component materials separately, a method in which the toner component materials are melt-kneaded or mixed, and the resulting mixture is mechanically pulverized into fine particles in an aqueous medium using a high-pressure pulverizer, a rotor-stator stirrer, a media-type pulverizer, etc., can be used. According to this method, the fine particles of toner components can be produced at one time, and therefore, the process can be simplified, and moreover, the release agent, the charge control agent, etc., can be uniformly dispersed in the binder resin. Accordingly, this is a very superior production method.

Next, a specific example of the method for producing the dispersion of precursor fine particles containing at least a binder resin by emulsion polymerization, which is one of the polymerization methods, will be described.

First, an oil phase component in which a vinyl-based polymerizable monomer and optionally a chain transfer agent are mixed is prepared. The resulting oil phase component is emulsified and dispersed in an aqueous phase component which is an aqueous solution of a surfactant, and a water-soluble polymerization initiator is added thereto, and the resulting mixture is heated to effect polymerization. In the oil phase component, a release agent, a charge control agent, etc., which is a toner component, may be mixed. Further, a dispersion in which fine particles of a release agent, a charge control agent, etc., are dispersed in an aqueous medium is added to the reaction mixture during polymerization, and such a component can be incorporated in the emulsion-polymerized particles. By the emulsion polymerization, a dispersion of fine particles containing toner components including at least a binder resin and having a size of from 0.01 to 1 μm can be prepared. As for the emulsion polymerization method, polymerization may be performed by adding the oil phase component dropwise to the aqueous phase component, or the polymerization initiator may be added again during polymerization for adjusting the molecular weight.

Next, a specific example of a method for producing the dispersion of first fine particles containing at least a binder resin by a phase inversion emulsification method will be described.

First, an oil phase component containing toner components including at least a binder resin is melted by heating. Then, an aqueous solution containing a surfactant and a pH adjusting agent is gradually added thereto. By adding the aqueous solution thereto, the phase is inverted from W/O to O/W. After completion of the phase inversion, the resulting mixture is cooled, whereby a dispersion of fine particles of toner components containing at least a binder resin and having a size of from 0.01 to 5 μm can be prepared. To the oil phase component, a surfactant, a pH adjusting agent, a solvent, deionized water, etc., may be added in advance. In particular, in the case of adding a solvent, the viscosity of the oil phase component is decreased, therefore, it is not necessary to perform heating in some cases. However, if a solvent is used, it is necessary to remove the solvent after completion of phase inversion emulsification.

Next, the method for aggregating the precursor fine particles will be described.

First, an aggregating agent is added to the dispersion liquid of the fine particles. The addition amount of the aggregating agent varies depending on the dispersion stability of the fine particles, and when the fine particles have a high dispersion stability, the addition amount is large, and when the fine particles have a low dispersion stability, the addition amount is small. Also, the addition amount varies depending on the type of the aggregating agent. When aluminum sulfate is used as the aggregating agent, the aluminum sulfate may be added in an amount of from 0.1 to 50 wt. %, preferably from 0.5 to 10 wt. % based on the amount of the fine particles. When an aggregating agent with high aggregating performance such as aluminum sulfate is used, after adding the aggregating agent, aggregated particles having a particle diameter of from 0.1 to 10 μm are obtained. On the other hand, when an aggregating agent with low aggregating performance such as sodium chloride is used, the fine particles are sometimes not aggregated when the aggregating agent is added. When adding the aggregating agent, in order to prevent rapid aggregation of the fine particles, a rotor stator disperser may be used. Further, in order to prevent rapid aggregation of the fine particles, before the aggregating agent is added, pH adjustment or addition of a surfactant may be performed for the dispersion liquid of the fine particles. By taking these measures, it becomes possible to make the particle diameter of the finally obtained toner uniform.

Subsequently, aggregation by heating is performed. By heating, aggregated particles having a particle diameter of from 2 μm to a target particle diameter are produced.

Then, fusion by heating is performed. To the resulting aggregated particles, a stabilizing agent such as a pH adjusting agent or a surfactant is added as needed thereby to stabilize the aggregated particles, and thereafter, the particles are heated at least to a temperature not lower than the Tg of the binder resin, whereby fusion of the surfaces of the aggregated particles is performed. By the fusion, the toner particles have a target particle diameter of final toner particles.

The aggregation and fusion can be sometimes performed simultaneously according to the type of fine particles, the solid content concentration, or the type of aggregating agent.

Further, the stirring conditions for the aggregation and fusion have a large influence on the particle diameter and the particle size distribution. The stirring rate may preferably be set so as to apply a proper shearing force. If the shearing is too weak, the particle diameter is increased and coarse particles are liable to be generated. Meanwhile, if the shearing is too strong, the particle diameter is decreased, and fine powder is liable to be generated. Further, in a reaction vessel, a baffle may be installed. The baffle has an effect of suppressing incorporation of bubbles, an effect of making the stirred state in the vessel uniform, and an effect of increasing the shearing force. Other than the stirring conditions, a temperature increasing rate, an additive feeding rate, etc., also have a large influence on the particle diameter and particle size distribution.

The surfaces of the aggregated particles can be coated with a resin. In order to achieve the coating, as needed, e.g., by a method in which resin particles, etc., are added to the dispersion liquid of the aggregated particles, the resin particles, etc., are attached to the surfaces of the aggregated particles by the addition of an aggregating agent, pH adjustment, etc., and then the attached resin particles, etc., are fused to the surfaces of the aggregated particles.

By the coating, it becomes possible to enclose the color material or the release agent on the surfaces of the toner particles, and the stability of images during continuous image formation on successive sheets is improved. However, in this embodiment, in order not to deteriorate the fixability, the coating resin may preferably have the same composition as the resin forming the aggregated particles.

In the above-described process for production of the core particles, production apparatus as described below can be generally used.

A kneader is not particularly limited as long as the kneader can melt-knead the materials, and examples thereof include a single-screw extruder, a twin-screw extruder, a pressure kneader, a Banbury mixer, and a Brabender mixer. Specific examples thereof include FCM (made by Kobe Steel, Ltd.), NCM (made by Kobe Steel, Ltd.), LCM (made by Kobe Steel, Ltd.), ACM (made by Kobe Steel, Ltd.), KTX (made by Kobe Steel, Ltd.), GT (made by Ikegai, Ltd.), PCM (made by Ikegai, Ltd.), TEX (made by the Japan Steel Works, Ltd.), TEM (made by Toshiba Machine Co., Ltd.), ZSK (made by Warner K.K.), and KNEADEX (made by Mitsui Mining Co., Ltd.).

A crusher is not particularly limited as long as the crusher can crush materials in a dry state, and examples thereof include a ball mill, an atomizer, Bantam Mill, a pulverizer, a hammer mill, a roll crusher, a cutter mill, and a jet mill.

A pulverizer is not particularly limited as long as the pulverizer can pulverize materials in a wet state, and examples thereof include a high-pressure pulverizer such as Nanomizer (made by Yoshida Kikai Co., Ltd.), Altimizer (made by Sugino Machine, Ltd.), NANO 3000 (made by Beryu Co., Ltd.), Microfluidizer (made by Mizuho Industrial Co., Ltd.), and Homogenizer (made by Izumi Food Machinery Co., Ltd.); a rotor stator stirrer such as Ultra Turrax (made by IKA Japan K.K.), T.K. Auto Homo Mixer (made by Primix Corporation), T.K. Pipeline Homo Mixer (made by Primix Corporation), T.K. Filmics (made by Primix Corporation), Clear mix (made by M-Technique Co., Ltd.), Clear SS5 (made by M-Technique Co., Ltd.), Cavitron (made by Eurotec, Ltd.), and Fine Flow Mill (made by Pacific Machinery & Engineering Co., Ltd.); and a media-type stirrer such as Visco mill (made by Aimex Co., Ltd.), Apex mill (made by Kotobuki Industries Co., Ltd.), Star Mill (made by Ashizawa Finetech, Ltd.), DCP Super flow (made by Nippon Eirich Co., Ltd.), MP Mill (made by Inoue Manufacturing Co., Ltd.), Spike Mill (made by Inoue Manufacturing Co., Ltd.), Mighty Mill (made by Inoue Manufacturing Co., Ltd.), and SC Mill (made by Mitsui Mining Co., Ltd.). Such a pulverizer can also be used when toner component particles and an aggregating agent are mixed.

As a washing device, for example, a centrifugal separator, a filter press, etc., is preferably used. As a washing liquid, for example, water, deionized water, purified water, water adjusted to an acidic pH, water adjusted to an alkaline pH, etc., is used.

As a drying device, for example, a vacuum dryer, an air flow dryer, a fluidized dryer, etc., is preferably used.

Examples of a dry mixer include Henschel Mixer (made by Mitsui Mining Co., Ltd.), Super Mixer (made by Kawata MFG Co., Ltd.), Ribocorn (made by Okawara Corporation), Nauta Mixer (made by Hosokawa Micron Corporation), Turbulizer (made by Hosokawa Micron Corporation), Cyclomix (made by Hosokawa Micron Corporation), Spiralpin Mixer (made by Pacific Machinery & Engineering Co., Ltd.) and Lodige Mixer (made by Matsubo Corporation).

(Production of Toner)

As described above, a water-soluble polymeric crosslinking agent and a water-soluble polycarboxylic acid may be sequentially added to an aqueous dispersion liquid of core particles as described above to cause a crosslinking reaction, thereby obtaining a dispersion liquid of encapsulated toner particles, followed by washing, solid-liquid separation, and drying, whereby encapsulated toner particles having a 50% volume-based median particle diameter Dv as measured by a Coulter counter method (measurement particle diameter rage: 2.0-60 μm) of 5 to 20 μm, are obtained. An external additive may be added to the toner particles, thereby obtaining a toner.

As the external additive, inorganic fine particles are added and mixed in an amount of from 0.01 to 20% by weight based on the amount of the toner particles and attached to the surfaces of the toner particles, whereby the fluidity or chargeability of the toner can be adjusted. As such inorganic fine particles, fine particles having an average particle diameter of from about 1 to 500 nm of silica, titania, alumina, strontium titanate, tin oxide, etc., can be used alone or by mixing two or more species thereof. It is preferred that as the inorganic fine particles, inorganic fine particles surface-treated with a hydrophobizing agent are used from the viewpoint of improvement of environmental stability. Further, other than such inorganic oxides, resin fine particles having a particle diameter of 1 μm or less may be externally added for improving the cleaning property.

EXAMPLES

Hereinafter, the embodiments will be more specifically described with reference to Examples and Comparative Examples. The measurement of physical values and the evaluation of toners obtained described in this specification including the following description were performed according to the following methods.

(Acid Value of Binder Resin Having Carboxyl Group)

The measurement was performed according to JIS K0070. As a solvent for the measurement, a mixed solvent of acetone and toluene (acetone:toluene=1:1 (volume ratio)) was used.

(Molecular Weight of Water-Soluble Polycarboxylic Acid)

The measurement was performed to obtain a weight-average molecular weight based on polyethylene glycol as the reference polymer by gel permeation chromatography (hereinafter referred to as "GPC"), and the measurement conditions for the GPC were as follows.

<Conditions for Measurement of Molecular Weight by GPC>

Column used: TSK guard column SWXL TSK gel G4000 SWXL+G3000 SWXL+G2000 SWXL made by Tosoh Corporation Eluent: An eluent solution was obtained by dissolving 115.6 g of sodium acetate tri-hydrate in a mixed solvent of 10999 g of water and 6001 g of acetonitrile, and then, adjusting the pH of the solution to 6.0 with acetic acid.

Injection amount: 100 μL of 0.5% of the eluent solution

Flow rate of eluent: 0.8 mL/min.

Column temperature: 40° C.

Reference substances: Polyethylene glycols (peak top molecular weights (Mp): 272500, 219300, 85000, 46000, 24000, 12600, 4250, 7100, and 1470)

Detector: Differential refractive index detector 410, made by Japan Waters Co., Ltd.

Analysis software: MILLENNIUM Ver. 3.21, made by Japan Waters Co., Ltd.

(Fixability)

A sample toner was placed in an MFP ("e-STUDIO 3520c", made by Toshiba Tec Corporation) modified for evaluation, and an unfixed image was formed. Then, in a fixing device (30 mm/s) modified for evaluation, the temperature was successively changed by an increment of 2.5° C., to determine a lowest fixable temperature, whereby the fixability was evaluated.

(Storage Stability)

The storage stability is a performance of a toner such that the toner is not aggregated or solidified under a high temperature as an ability of withstanding the temperature in the main body of an MFP and the temperature during transportation. The method for evaluating the storage stability was as follows: 20 g of a toner was put in a 100-cc polyethylene bottle and the bottle was left in a constant temperature bath which was set to a predetermined temperature for 8 hours. Thereafter, in "Powder Tester PT-E" (made by Hosokawa Micron Corporation) in which a 42-mesh sieve (opening: 0.351 mm) was installed, the toner was sieved for 10 seconds by setting the displacement of a vibration meter ("Thermo Vibro VM-4515 S1") to 0.6 mm, and evaluation was performed on the basis of the weight of the toner remaining on the sieve. When the amount of the toner remaining on the sieve is large, the storage stability of the toner is evaluated to be poor. The weight of the toner remaining on the sieve is preferably 1 g or less from the practical point of view.

Prior to the production of each of the toners of Examples and Comparative Examples, (a dispersion liquid of) core particles (was) were produced as follows.

[Core Particles 1]

<Preparation of Dispersion Liquid of Core Particles 1>

Polyester resin (Mw: 10000, Tg: 50° C., Tm: 90° C., acid value (AV): 25) 90 wt. parts, Pigment Blue 15:3 (made by Clariant Co., Ltd.): 5 wt. parts, and Rice wax: 5 wt. parts.

The above ingredients were mixed, and the resulting mixture was melt-kneaded using a twin-screw kneader set to a temperature of 120° C., to obtain a kneaded material.

The thus-obtained kneaded material was coarsely crushed to a volume-average particle diameter of 0.1 mm or less using a crusher ("Bantam Mill", made by Hosokawa Micron Corporation), whereby coarse particles were obtained.

30 Wt. parts of the thus obtained coarse particles were mixed with 3 wt. parts of sodium dodecylbenzene sulfonate as a surfactant, 2 wt. parts of dimethylaminoethanol as an alkaline pH adjusting agent, and 65 wt. parts of deionized water, whereby a dispersion liquid was prepared.

Subsequently, the above-prepared dispersion liquid of the coarse particles was subjected to a pulverization treatment at 180° C. and 150 MPa using a high-pressure pulverizer ("NANO 3000", made by Beryu Co., Ltd.) provided with a high-pressure pipe for heat exchange having a length of 12 m immersed in an oil bath as a heating unit, a high-pressure pipe including nozzles having diameters of 0.13 μm and 0.28 μm, respectively, arranged in a row as a pressurizing unit, a medium-pressure pipe including cells having pore diameters of 0.4, 1.0, 0.75, 1.5, and 1.0 μm, respectively, arranged in a row as a depressurizing unit, and a heat exchange pipe having a length of 12 m capable of cooling with tap water as a cooling unit. After the pressure was reduced while maintaining the temperature at 180° C., the dispersion liquid was cooled to 30° C., whereby a dispersion liquid of fine particles was obtained. The 50% volume-average particle diameter Dv of the thus obtained particles was measured using a laser diffraction particle size distribution analyzer ("SALD-7000", made by Shimadzu Corporation) and found to be 0.52 μm.

35 Wt. parts of the thus obtained dispersion liquid of fine particles and 65 wt. parts of deionized water were mixed with each other, and while stirring the resulting mixture at 6500 rpm in a homogenizer ("T25", made by IKA Japan K.K.), 10 wt. parts of an aqueous solution of 5% aluminum sulfate as an aggregating agent was added thereto, and then, the resulting dispersion liquid was heated to 40° C., whereby aggregated particles were obtained.

Thereafter, 20 wt. parts of an aqueous solution of 10% sodium polycarboxylic acid as a stabilizing agent was added thereto, and the resulting mixture was further heated to 65° C. to effect fusion, whereby a dispersion liquid of Core particles 1 was obtained.

The particle diameter of the aggregated and fused particles was measured using a Coulter counter ("Multisizer 3", made by Beckman Coulter, Inc., aperture diameter: 100 μm) and found that the 50% volume-average diameter Dv was 5.1 μm, the 50% number average diameter Dp was 4.5 μm, and the particles had a sharp particle size distribution.

<Preparation of Wet Core Particles 1>

The solid component in the thus obtained dispersion liquid of Core particles 1 was washed by repeating filtration and washing with deionized water until the electrical conductivity of the filtrate became 50 μS/cm, whereby Wet Core particles 1 were prepared.

<Preparation of Core Particles 1>

Wet Core particles 1 were dried using a vacuum dryer until the water content became 1.0% by weight or less, whereby Core particles 1 were obtained.

[Core Particles 2]

<Preparation of Dispersion Liquid of Core Particles 2>

Polyester resin (Mw: 10000, Tg: 45° C., Tm: 85° C., AV: 18): 95 wt. parts, and

Rice wax: 5 aw. Parts.

The above ingredients were mixed, and the resulting mixture was melt-kneaded using a twin-screw kneader set to a temperature of 120° C., to obtain a kneaded material.

The thus-obtained kneaded material was coarsely crushed to a volume-average particle diameter of 0.1 mm or less using a crusher ("Bantam Mill", made by Hosokawa Micron Corporation), whereby coarse particles were obtained.

30 Wt. parts of the thus obtained coarse particles were mixed with 3 wt. parts of sodium dodecylbenzene sulfonate as a surfactant, 2 wt. parts of dimethylaminoethanol as an alkaline pH adjusting agent, and 65 wt. parts of deionized water, whereby a dispersion liquid was prepared.

Subsequently, the above-prepared dispersion liquid of the coarse particles was subjected to a pulverization treatment at 180° C. and 150 MPa using "NANO 3000" (made by Beryu Co., Ltd.). After the pressure was reduced while maintaining the temperature at 180° C., the dispersion liquid was cooled to 30° C., whereby a dispersion liquid of fine particles was obtained. The 50% volume-average particle diameter Dv of the thus obtained particles was measured using "SALD-7000" (made by Shimadzu Corporation) and found to be 0.45 μm.

On the other hand, a coloring material composed of 1 wt. part of 3-(2-ethoxy-4-diethylaminophenyl)-3-(1-ethyl-2-methylindol-3-yl)-4-azaphthalide as a leuco dye, 5 wt. parts of 2,2-bis(4-hydroxyphenyl)hexafluoropropane as a color-developing agent, and 50 wt. parts of a diester compound of pimelic acid and 2-(4-benzyloxyphenyl)ethanol as a decoloring agent, was dissolved by heating. Then, 20 wt. parts of an aromatic polyvalent isocyanate prepolymer and 40 wt. parts of ethyl acetate were mixed therein as encapsulating agents, and the resulting solution was poured into 250 wt. parts of an aqueous solution of 8% polyvinyl alcohol, and the resulting mixture was emulsified and dispersed. After stirring was continued at 70° C. for about 1 hour, 2 wt. parts of a water-soluble aliphatic modified amine was added thereto as a reaction agent, and stirring was further continued for about 3 hours while maintaining the temperature of the liquid at 90° C., whereby colorless capsule particles were obtained. Further, the resulting dispersion of the capsule particles was placed in a freezer (at −30° C.) to develop a color, whereby a dispersion liquid of erasable color material was obtained. The 50% volume-average particle diameter Dv of the colored particles C1 was measured using "SALD-7000" (made by Shimadzu Corporation) and found to be 2 μm. Further, the colored particles C1 had a completely decoloring temperature Th of 79° C. and a completely coloring temperature Tc of −20° C.

30 Wt. parts of the obtained dispersion liquid of fine particles, 5 wt. parts of the obtained dispersion liquid of erasable color material, and 65 wt. parts of deionized water were mixed with one another, and while stirring the resulting mixture at 6500 rpm in "Homogenizer T25" (made by IKA Japan K.K.), 10 wt. parts of an aqueous solution of 5% aluminum sulfate as an aggregating agent was added thereto, and then, the resulting dispersion liquid was heated to 47° C., whereby aggregated particles were obtained.

Thereafter, 20 wt. parts of an aqueous solution of 10% sodium polycarboxylic acid as a stabilizing agent was added thereto, and the resulting mixture was further heated to 65° C. to effect fusion, whereby a dispersion liquid of core particles 2 was obtained.

The particle diameter of the aggregated and fused particles was measured using "Multisizer 3" (made by Beckman Coulter, Inc.) and found to show a sharp particle size distribution including a 50% volume-average diameter Dv of 9.5 μm and a 50% number-average diameter Dp of 7.1 μm.

<Preparation of Wet Core Particles 2>

The solid component in the thus obtained dispersion liquid of Core particles 2 was washed by repeating filtration and washing with deionized water until the electrical conductivity of the filtrate became 50 μS/cm, whereby Wet Core particles 2 were prepared.

<Preparation of Core Particles 2>

Wet Core particles 2 were dried using a vacuum dryer until the water content became 1.0% by weight or less, whereby Core particles 2 were obtained.

[Core Particles 3]

Core particles 3 (Dv=5.3 μm, Dp=5.1 μm) were obtained in the same manner as Core particles 1 except for using Polyester resin (Mw: 25000, Tg: 55° C., Tm: 120° C., acid value (AV): 14) in place of Polyester resin (Mw: 10000, Tg: 50° C., Tm: 90° C., AV: 25) in the preparation of Core particles 1.

Example 1

10 Parts by weight of Core particles 1 in a dry state obtained above, 0.36 wt. part of an aqueous solution of a water-soluble acrylic polymer having an oxazoline group ("EPOCROS WS700", made by Nippon Shokubai Co., Ltd.; mass per mole of oxazoline group: 220, solid content: 25%) as a crosslinking agent, and 89.19 wt. parts of deionized water were mixed and dispersed, and then, the pH of the resulting dispersion was adjusted to 10 with an aqueous solution of 10% sodium hydroxide. Then, the dispersion was heated to 80° C. while stirring the dispersion with a paddle blade. After the temperature reached 80° C., 0.45 wt. part of an aqueous solution obtained by diluting a polyacrylic acid ("AQUALIC HL415", made by Nippon Shokubai Co., Ltd., molecular weight: 10000, solid content: 45%) as a water-soluble polymer having a carboxyl group, to a solid content of 10% was added thereto, and the resulting mixture was left to stand at 80° C. for 3 hours to complete a crosslinking reaction.

Thereafter, the solid component in the thus obtained dispersion liquid was washed by repeating filtration and washing with deionized water until the electrical conductivity of the filtrate became 50 μS/cm. Then, the washed particles were dried using a vacuum dryer until the water content became 1.0% by weight or less, whereby dried particles were obtained.

After drying, based on 100 wt. parts of the toner particles, 2 wt. parts of hydrophobic silica having a volume-average particle diameter of 30 nm and 0.5 wt. part of titanium oxide having a volume-average particle diameter of 20 nm were attached as additives to the surfaces of the toner particles, whereby a desired electrophotographic toner was obtained.

Example 2

10 Wt. parts of Core particles 1, 0.36 wt. part of a crosslinking agent ("EPOCROS WS700", made by Nippon Shokubai Co., Ltd.; solid content: 25%), and 89.19 wt. parts of deionized water were mixed and dispersed, and then, the dispersion was heated to 40° C. while stirring the dispersion with a paddle blade. After the temperature reached 40° C., 0.45 wt. part of an aqueous solution of a polyacrylic acid ("AQUALIC HL415", made by Nippon Shokubai Co., Ltd., molecular weight: 10000) at a solid content of 10% was added thereto, and the resulting mixture was left to stand at 40° C. for 6 hours to complete a crosslinking reaction.

Thereafter, the solid component (toner particles) in the thus obtained dispersion liquid, was subjected to filtration, washing, drying, and external addition of hydrophobic silica and titanium oxide in the same manner as in Example 1, whereby an electrophotographic toner was obtained.

Example 3

10 Wt. parts of Core particles 1, 0.36 wt. part of a crosslinking agent ("EPOCROS WS700", made by Nippon Shokubai Co., Ltd.; solid content: 25%), and 88.74 wt. parts of deionized water, were mixed and dispersed, and then, the dispersion was heated to 40° C. while stirring the dispersion with a paddle blade. After the temperature reached 40° C., 0.9 wt. part of an aqueous solution of a polyacrylic acid ("AQUALIC HL415", made by Nippon Shokubai Co., Ltd., molecular weight: 10000) at a solid content of 10% was added thereto, and the resulting mixture was left to stand at 40° C. for 6 hours to complete a crosslinking reaction.

Thereafter, the solid component (toner particles) in the thus obtained dispersion liquid, was subjected to filtration, washing, drying, and external addition of hydrophobic silica and titanium oxide in the same manner as in Example 1, whereby an electrophotographic toner was obtained.

Example 4

10 Wt. parts of Core particles 1, 0.36 wt. parts of a crosslinking agent ("EPOCROS WS700", made by Nippon Shokubai Co., Ltd.; solid content: 25%), and 89.19 wt. parts of deionized water, were mixed and dispersed, and then, the pH of the resulting dispersion was adjusted to 10. Thereafter, the dispersion was heated to 80° C. while stirring the dispersion with a paddle blade. After the temperature reached 80° C., 0.45 wt. part of an aqueous solution of a polyacrylic acid ("AQUALIC AS58", made by Nippon Shokubai Co., Ltd., molecular weight: 800000) at a solid content of 10% was added thereto, and the resulting mixture was left to stand at 80° C. for 3 hours to complete a crosslinking reaction.

Thereafter, the solid component (toner particles) in the thus obtained dispersion liquid, was subjected to filtration, washing, drying, and external addition of hydrophobic silica and titanium oxide in the same manner as in Example 1, whereby an electrophotographic toner was obtained.

Example 5

10 Wt. parts of Core particles 1, 0.18 wt. parts of a crosslinking agent ("EPOCROS WS700", made by Nippon Shokubai Co., Ltd.; solid content: 25%), and 89.37 wt. parts of deionized water, were mixed and dispersed, and then, the pH of the resulting dispersion was adjusted to 10. Thereafter, the dispersion was heated to 80° C. while stirring the dispersion with a paddle blade. After the temperature reached 80° C., 0.45 wt. parts of an aqueous solution of a polyacrylic acid ("AQUALIC HL415", made by Nippon Shokubai Co., Ltd., molecular weight: 10000) at a solid content of 10% was added thereto, and the resulting mixture was left to stand at 80° C. for 3 hours to complete a crosslinking reaction.

Thereafter, for the solid component (toner particles) in the thus obtained dispersion liquid, filtration, washing, drying, and external addition of hydrophobic silica and titanium oxide were performed in the same manner as in Example 1, whereby an electrophotographic toner was obtained.

Example 6

10 Wt. parts of Core particles 1, 0.36 wt. part of an aqueous solution of a water-soluble acrylic polymer having an oxazoline group ("EPOCROS WS300", made by Nippon Shokubai Co., Ltd.; mass per mole of oxazoline group: 130, solid content: 25%) as a crosslinking agent, and 89.19 wt. parts of deionized water, were mixed and dispersed, and then, the pH of the resulting dispersion was adjusted to 10. Thereafter, the dispersion was heated to 80° C. while stirring the dispersion with a paddle blade. After the temperature reached 80° C., 0.45 wt. part of an aqueous solution of a polyacrylic acid ("AQUALIC HL415", made by Nippon Shokubai Co., Ltd., molecular weight: 10000) with a solid content of 10% was added thereto, and the resulting mixture was left to stand at 80° C. for 3 hours to complete a crosslinking reaction.

Thereafter, for the solid component (toner particles) in the thus obtained dispersion liquid, filtration, washing, drying, and external addition of hydrophobic silica and titanium oxide were performed in the same manner as in Example 1, whereby an electrophotographic toner was obtained.

Example 7

10 Wt. parts of Core particles 1, 0.36 wt. parts of an aqueous solution of a carbodiimide group-containing polymer ("CARBODILITE V02-L2", made by Nisshinbo Chemical Inc.; mass per mole of carbodiimide group: 385, solid content: 25%) as a crosslinking agent, and 89.19 wt. parts of deionized water; were mixed and dispersed, and then, the pH of the resulting dispersion was adjusted to 10. Thereafter, the dispersion was heated to 80° C. while stirring the dispersion with a paddle blade. After the temperature reached 80° C., 0.45 wt. part of an aqueous solution of a polyacrylic acid ("AQUALIC HL415", made by Nippon Shokubai Co., Ltd.; molecular weight: 10000) at a solid content of 10% was added thereto, and the resulting mixture was left to stand at 80° C. for 3 hours to complete a crosslinking reaction.

Thereafter, the solid component (toner particles) in the thus obtained dispersion liquid, was subjected to filtration, washing, drying, and external addition of hydrophobic silica and titanium oxide in the same manner as in Example 1, whereby an electrophotographic toner was obtained.

Example 8

20 Wt. parts of Wet Core particles 1 (solid content: 50%), 0.36 wt. parts of a crosslinking agent ("EPOCROS WS700", made by Nippon Shokubai Co., Ltd.; solid content: 25%), and 79.19 wt. parts of deionized water, were mixed and dispersed, and then, the dispersion was heated to 40° C. while stirring the dispersion with a paddle blade. After the temperature reached 40° C., 0.45 wt. parts of an aqueous solution of a polyacrylic acid ("AQUALIC HL415", made by Nippon Shokubai Co., Ltd., molecular weight: 10000) at a solid content of 10% was added thereto, and the resulting mixture was left to stand at 40° C. for 6 hours to complete a crosslinking reaction.

Thereafter, the solid component (toner particles) in the thus obtained dispersion liquid, was subjected to filtration, washing, drying, and external addition of hydrophobic silica and titanium oxide in the same manner as in Example 1, whereby an electrophotographic toner was obtained.

Example 9

100 Wt. parts of the dispersion liquid of Core particles 1 (solid content: 10%) and 0.36 wt. parts of a crosslinking agent ("EPOCROS WS700", made by Nippon Shokubai Co., Ltd.; solid content: 25%), were mixed and dispersed, and then, the dispersion was heated to 40° C. while stirring the dispersion with a paddle blade. After the temperature reached 40° C., 0.45 wt. part of an aqueous solution of a polyacrylic acid ("AQUALIC HL415", made by Nippon Shokubai Co., Ltd.; molecular weight: 10000) at a solid content of 10% was added thereto, and the resulting mixture was left to stand at 40° C. for 6 hours to complete a crosslinking reaction.

Thereafter, the solid component (toner particles) in the thus obtained dispersion liquid, was subjected to filtration, washing, drying, and external addition of hydrophobic silica and titanium oxide were performed in the same manner as in Example 1, whereby an electrophotographic toner was obtained.

Example 10

100 Wt. parts of the dispersion liquid of Core particles 2 (solid content: 10%) and 0.36 wt. part of "EPOCROS WS700" (made by Nippon Shokubai Co., Ltd.) (solid content: 25%) as a crosslinking agent, were mixed and dispersed, and then, the dispersion was heated to 40° C. while stirring the dispersion with a paddle blade. After the temperature reached 40° C., 0.45 wt. part of an aqueous solution of a polyacrylic acid ("AQUALIC HL415", made by Nippon Shokubai Co., Ltd., molecular weight: 10000) at a solid content of 10% was added thereto, and the resulting mixture was left to stand at 40° C. for 6 hours to complete a crosslinking reaction.

Thereafter, the solid component (toner particles) in the thus obtained dispersion liquid, was subjected to filtration, washing, drying, and external addition of hydrophobic silica and titanium oxide in the same manner as in Example 1, whereby an electrophotographic toner was obtained.

Comparative Example 1

Core particles 1 in a powder form not subjected to an encapsulation treatment was used as toner particles as such, and 2 wt. parts of hydrophobic silica and 0.5 wt. parts of titanium oxide were externally added and attached to the surfaces of the toner particles, whereby an electrophotographic toner was obtained.

Comparative Example 2

Core particles 2 in a powder form not subjected to an encapsulation treatment was used as toner particles as such, and 2 wt. parts of hydrophobic silica and 0.5 wt. parts of titanium oxide were attached as additives to the surfaces of the toner particles, whereby an electrophotographic toner was obtained.

Comparative Example 3

Core particles 3 (Dv=5.3 μm, Dp=5.1 μm) which were obtained in the same manner as Core particles 1 except for using a polyester resin (Mw: 25000, Tg: 55° C., Tm: 120° C., acid value (AV): 14) in place of Polyester resin (Mw: 10000, Tg: 50° C., Tm: 90° C., AV: 25) used in the preparation of Core particles 1 and in Comparative Example 1, as toner particles as such, and 2 wt. parts of hydrophobic silica and 0.5 wt. parts of titanium oxide were externally added and attached to the surfaces of the toner particles, whereby an electrophotographic toner was obtained.

The toners obtained in the above Examples and Comparative Examples were evaluated with respect to fixability and storage stability by the methods described above.

The outlines of the above Examples and Comparative Examples and the obtained results of the evaluation of the toners are summarized and shown in the following Table 1.

TABLE 1

| | | Crosslinking conditions | | | | | | Fixability | Storage | |
|---|---|---|---|---|---|---|---|---|---|---|
| | | Crosslinking agent | | Polyacrylic acid | | | | Lowest Fixable | stability: 42-mesh 0 n | |
| | Core particles | | Amount* | Molecular | Amount* | Temperature | Time | Temp. | (g) | |
| Example | (Toner particles) | Name | (%) | weight | (%) | (° C.) | (Hrs.) | (° C.) | 50° C. | 55° C. |
| 1 | Core particles 1, Powdery | WS700 | 1 | 10,000 | 0.5 | 80 | 3 | 80 | 0.3 | 0.5 |
| 2 | Core particles 1, Powdery | WS700 | 1 | 10,000 | 0.5 | 40 | 6 | 80 | 0.3 | 3.2 |
| 3 | Core particles 1, Powdery | WS700 | 1 | 10,000 | 1 | 40 | 6 | 80 | 0.3 | 0.8 |
| 4 | Core particles 1, Powdery | WS700 | 1 | 800,000 | 0.5 | 80 | 3 | 80 | 0.3 | 0.8 |
| 5 | Core particles 1, Powdery | WS700 | 0.5 | 10,000 | 0.5 | 40 | 6 | 80 | 0.3 | 4.1 |
| 6 | Core particles 1, Powdery | WS300 | 1 | 10,000 | 0.5 | 80 | 3 | 80 | 0.3 | 0.5 |
| 7 | Core particles 1, Powdery | V02-L2 | 1 | 10,000 | 0.5 | 80 | 3 | 80 | 0.3 | 0.6 |
| 8 | Wet Core particles 1 | WS700 | 1 | 10,000 | 0.5 | 40 | 6 | 80 | 0.3 | 3.2 |
| 9 | Core particles 1, Dispersion liquid | WS700 | 1 | 10,000 | 0.5 | 40 | 6 | 80 | 0.3 | 2.5 |
| 10 | Core particles 2, Dispersion liquid | WS700 | 1 | 10,000 | 1 | 40 | 6 | 70 | 0.3 | 2.8 |
| Comparative 1 | (Core particles 1, Powdery) | — | — | — | — | — | — | 80 | 20 | 20 |
| Comparative 2 | (Core particles 2, Powdery) | — | — | — | — | — | — | 70 | 20 | 20 |
| Comparative 3 | (Core particles 3, Powdery) | — | — | — | — | — | — | 100 | 0.3 | 0.5 |

*Amount in wt. % with respect to the amount of binder resin in the core particles The results shown in the above Table 1 show that the toners of Examples obtained according to this embodiment by coating the core particles containing a binder resin having a carboxyl group sequentially with a water-soluble crosslinking agent and a water-soluble polycarboxylic acid to cause a crosslinking reaction were hardly aggregated (at a level of 0.3 g on the 42-mesh sieve) at an environmental temperature of at least 50° C. although the toner had a lowest fixable temperature of as low as 80° C. or lower, whereby favorable fixability and favorable storage stability were harmonized. On the other hand, the toners of Comparative Example 1 and Comparative Example 2, in which a powder of the core particles used in the Examples was used as toner particles as such and without being subjected to coating, exhibited lowest fixable temperatures of from 70 to 80° C., which was low, and therefore had favorable fixability, whereas with respect to storage stability, even at an environmental temperature of 50° C., the whole amount (20 g) of the sample toner remained on the 42-mesh sieve, and therefore, the storage stability was not improved at all. Meanwhile, the toner of Comparative Example 3 which was not subjected to a coating treatment according to this embodiment was not accompanied with a problem regarding the storage stability because the glass transition temperature of the binder resin was higher, but the lowest fixable temperature thereof increased to 100° C., and desired harmonization between fixability and storage stability was not obtained.

Incidentally, as for the toner of Example 10, the completely decoloring temperature of the color material is 79° C., and it is necessary to fix the toner at a temperature lower than 79° C. Although depending on the completely erasing temperature of the color material, it is not easy to increase the completely erasing temperature of the color material and to sufficiently increase the difference between the coloring temperature and the erasing temperature due to restrictions on materials. In view of this, it is desired that the erasing temperature is set to 85 to 120° C. and the fixing temperature is set to about 85 to 70° C., so as to obtain a difference between the erasing temperature and the fixing temperature of 10° C. or more. It has been extremely difficult to achieve both of the low-temperature fixability and the improvement of storage stability for an erasable toner which has been required to satisfy a low-temperature fixability as described above, whereas according to Example 10, it was possible to provide a toner excellent in terms of both low-temperature fixability and storage stability.

FIG. 1 is a schematic arrangement view showing an overall organization of an image forming apparatus to which a developer according to this embodiment is applicable.

As illustrated, a color image forming apparatus of a four-drum tandem type (MFP) 1 is provided with a scanner section 2 and a paper discharge section 3 at an upper section thereof.

The color image forming apparatus 1 has an image forming unit 11 below an intermediate transfer belt 10. The image forming unit 11 includes four sets of image forming units 11Y, 11M, 11C and 11E arranged in parallel along the intermediate transfer belt 10. The image forming units 11Y, 11M, 11C and 11E form yellow (Y), magenta (M), cyan (C) and decolorable (or erasable) blue (E) toner images, respectively.

The color image forming apparatus 1 has three image forming modes including (1) a mode of forming images using developers selected from three colors Y, M and C, (2) a mode of forming images using developers of Y, M and C and a decolorable toner, and (3) a mode of forming images using only a decolorable toner, and effects image formation by selecting any one of these modes. The evaluation of the fixability of decolorable toners in the above-mentioned Examples, image formation was performed by selecting the mode (3) of forming images using only a decolorable toner and operating only the image forming unit 11E The image forming units 11Y, 11M, 11C and 11E have photosensitive drums 12Y, 12M, 12C and 12E, respectively, as image-bearing members, respectively. Each of the photosensitive drums 12Y, 12M, 12C and 12E rotates in the direction of an arrow m. Around the photosensitive drums 12Y, 12M, 12C and 12E, electric chargers 13Y, 13M, 13C and 13E, developing devices 14Y, 14M, 14C and 14E and photosensitive drum cleaners 16Y, 16M, 16C and 16E, for the respective drums, are disposed along the rotational direction.

Between each of the electric chargers 13Y, 13M, 13C and 13E and each of the developing devices 14Y, 14M, 14C and 14E, the photosensitive drums 12Y, 12M, 12C and 12E, light are irradiated with light from a laser exposing device (latent image forming device) 17 to form electrostatic latent images on the photosensitive drums 12Y, 12M, 12C and 12E.

The developing devices 14Y, 14M, 14C and 14E supply toners on the latent images on the photosensitive drums 12Y, 12M, 12C and 12E.

An intermediate transfer belt 10 is disposed under tension around a backup roller 21, a driven roller 20 and first to third tension rollers 22 to 24 and is rotated in the direction of an arrow S. The intermediate transfer belt 10 faces and is in contact with the photosensitive drums 12Y, 12M, 12C and 12E. At the positions where the intermediate transfer belt 10 faces the photosensitive drums 12Y, 12M, 12C and 12E, primary transfer rollers 18Y, 18M, 18C and 18E are provided, respectively. The primary transfer rollers 18Y, 18M, 18C and 18E are electroconductive rollers and supply primary transfer bias voltages to respective transfer sections.

A secondary transfer roller 27 is disposed to face a secondary transfer section of the intermediate transfer belt 10 supported by the backup roller 21. At the secondary transfer section, a predetermined secondary transfer bias is applied to the backup roller 21 which is an electroconductive roller. When a paper sheet P (P1 or P2) passes between the intermediate transfer belt 10 and the secondary transfer roller 27, the toner image on the intermediate transfer belt 10 is secondarily transferred to the paper sheet P. After the secondary transfer, the intermediate transfer belt 10 is cleaned by a belt cleaner 10*a*.

Below the laser exposure device 17 is disposed a paper feed cassette 4 for supplying paper sheets toward the secondary transfer roller 27. On the right side of the color image forming apparatus 1 is disposed a manual paper feed mechanism for feeding paper sheets manually supplied.

Along the path from the paper feed cassette 4 to the secondary transfer roller 27, a pickup roller 4*a*, a separation roller 28*a* and 28*b*, conveying rollers 28*b* and a resist roller pair 36 are provided to form a paper feed mechanism. Along the path from a manual feed tray 31*a* of the manual feed mechanism 31 to the resist roller pair 36, a manual feed pickup roller 31*b* and a manual feed separation roller 31*c* are provided.

Further, along a vertical conveying path 34 for conveying paper sheets in a direction of from the paper feed cassette 4 or the manual feed tray 31*a* to the secondary transfer roller 27, a media sensor 39 is disposed for detecting the type of fed paper sheets. The color image forming apparatus 1 is composed to be able to control the speed of conveying paper sheets, transfer condition, fixing condition, etc., based on the detection result given by the media sensor 39. Further, a fixing device 30 is provided downstream of the secondary transfer section along the vertical conveying path 34. Paper sheets taken out of the paper feed cassette 4 or supplied from the manual feed mechanism 31 are conveyed along the vertical conveying path 34, through the resist roller pair 36 and the secondary transfer roller 27 to the fixing device 30. The fixing device 30 includes a fixing belt 53 wound about a pair of a heating roller 51 and a drive roller 52, and a mating roller 54 disposed opposite to the heating roller 51 via the fixing belt 53. A paper sheet carrying a toner image transferred at the secondary transfer section is conveyed to between the fixing belt 53 and the mating roller 54 for being heated by the heating roller 51 to fix the toner image onto the paper sheet. Downstream of the fixing device 30, a gate 33 which guides the paper sheet P to either a paper discharge roller 41 or a reconveying unit 32 is provided. A paper sheet P guided to the paper discharge roller 41 is discharged to a paper discharge section 3. A paper sheet P guided to the reconveying unit 32 is guided to the secondary transfer roller 27 again.

The image forming section 11E integrally includes the photosensitive drum 11 and process means and is disposed to be freely attached to and detached from the main assembly of the color image forming apparatus 1. The image forming sections 11*y*, 11M and 11C also have similar structures as the section 11. The color image forming apparatus 1 will be described in more detail with reference to FIGS. 2 to 5.

Figure 2:
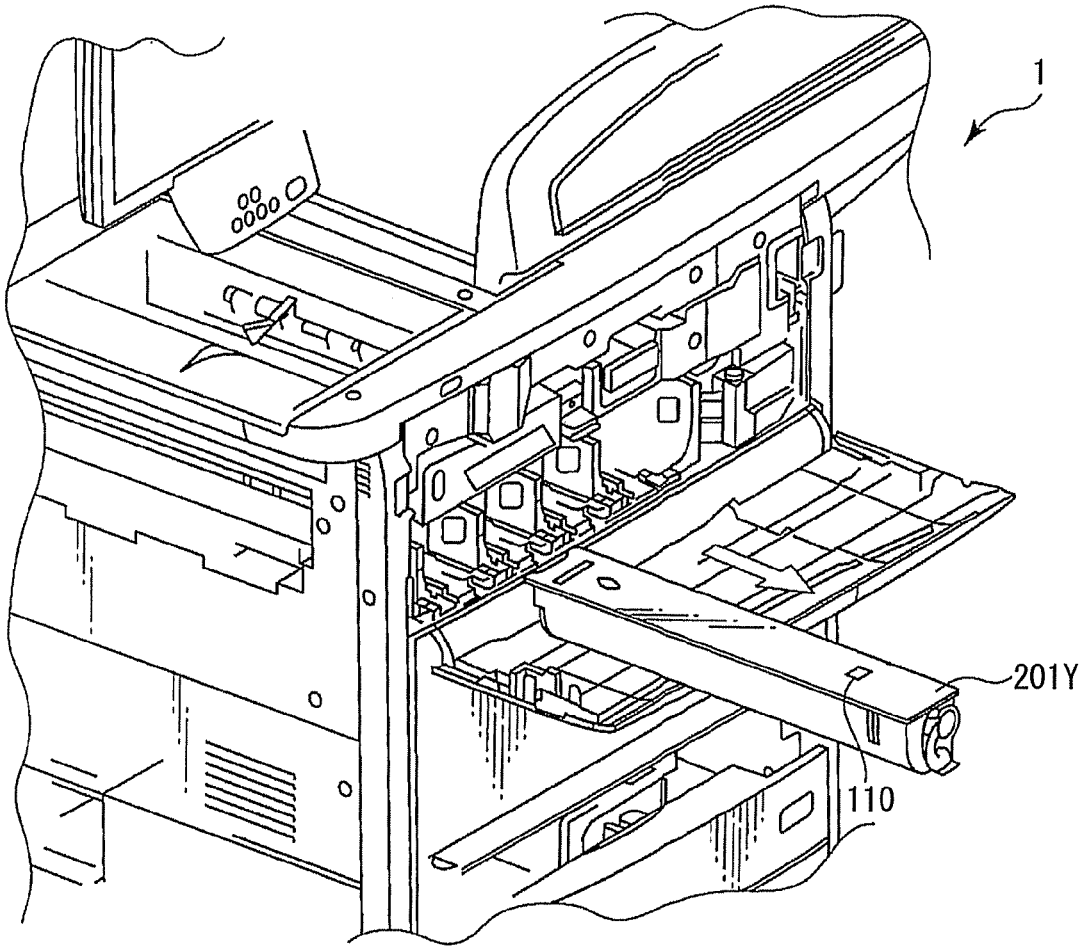
FIG. 2 is a partial schematic view of an image forming apparatus for illustrating a positional relationship of process (or toner) cartridges with the apparatus.
Figure 3:
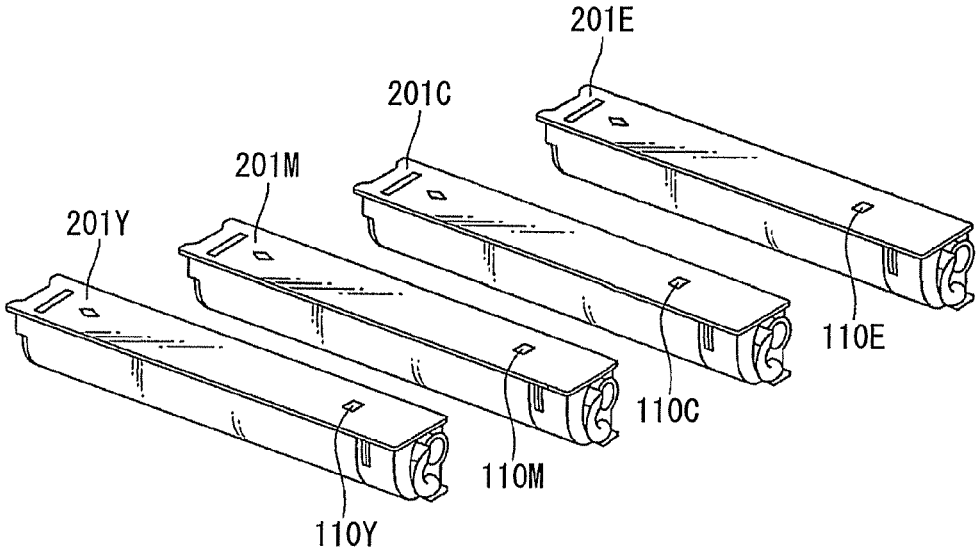
FIG. 3 is a schematic perspective view illustrating an arrangement of four color process (or toner) cartridges.

As shown in FIGS. 2 and 3, the color image forming apparatus 1 has toner cartridges 201Y, 201M, 201C, and 201E for supplying the toner of respective colors to the development devices 14Y, 14M, 14C, and 14E. The toner cartridges 201Y, 201M, 201C, and 201E are detachably mounted to the image forming apparatus 1. In order to achieve right matching with the development apparatus 14Y, 14M, 14C, and 14E, IC chips 110Y, 110M, 110C, and 110E having memorized each color information of the developers are provided to the toner cartridges of respective colors.

Figure 4:
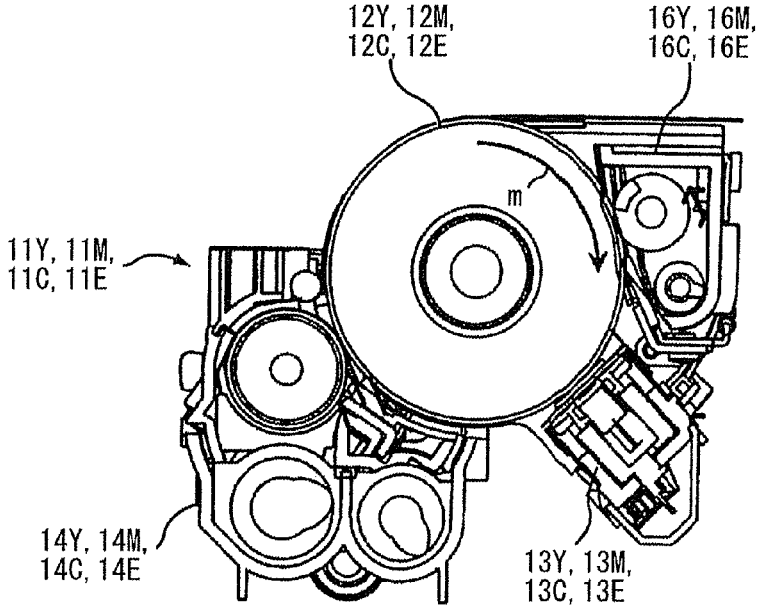
FIG. 4 is a sectional view illustrating a structure of a process unit (cartridge) including several process devices to be disposed surrounding a photosensitive drum.

FIG. 4 is a sectional view of the image forming sections 11Y, 11M, 11C, and 11E. If the image forming section 11E is taken for example, it is composed as a process unit (cartridge) including a photosensitive drum 12E, an electrification charger 13E, a developing device 14E, and a cleaning device 16E, combined integrally. The image forming sections 11Y, 11M, and 11C are also in similar structures.

Figure 5:
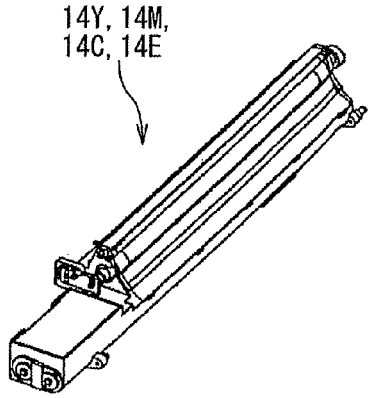
FIG. 5 is a perspective view of a process unit (cartridge) including only a developing device.

Incidentally, although FIG. 4 illustrates process units each including all the process means (devices) around the photosensitive drum are integrated, it is also possible to compose a developer cartridge including only a developing device 14Y, 14M, 14C, or 14E which is detachably mountable to a color image forming apparatus (MFP) 1 as shown in FIG. 5

While certain embodiments have been described, these embodiments have been presented by way of example only, and are not intended to limit the scope of the inventions. Indeed the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A toner, comprising:

core particles comprising at least a polyester resin having a carboxyl group and a coloring agent, and a crosslink coating formed by reacting the core particles successively with a water-soluble crosslinking agent and a water-soluble polymer having a carboxyl group.

2. The toner according to claim 1, wherein the water-soluble polymer having a carboxyl group is an acrylic polymer.

3. The toner according to claim 2, wherein the polyester resin has an acid value of 5 or more.

4. The toner according to claim 1, wherein the polyester resin has an acid value of 5 or more.

5. A toner cartridge, containing the toner according to claim 1.

6. A process cartridge, comprising:

at least a photosensitive member, and a developing device containing the toner according to claim 1.

7. An image forming apparatus, containing the toner according to claim 1.

8. A process for production of a toner, comprising:

mixing core particles comprising at least a polyester resin having a carboxyl group and a coloring agent with a water-soluble crosslinking agent capable of crosslinking with a carboxyl group in an aqueous dispersion medium, and then adding a water-soluble polymer having a carboxyl group to the aqueous dispersion medium, to cause a crosslinking reaction.

9. The process according to claim 8, wherein the polyester resin has an acid value of 5 or more.

10. The process according to claim 8, wherein the water-soluble polymer having a carboxyl group is an acrylic polymer.

11. The process according to claim 10, wherein the polyester resin has an acid value of 5 or more.

* * * * *